United States Patent [19]

May

[11] Patent Number: 4,511,033

[45] Date of Patent: Apr. 16, 1985

[54] PROMOTIONAL ATTACHMENT FOR BEVERAGE PACKAGES

[75] Inventor: Ronald J. May, Waukesha, Wis.

[73] Assignee: American Audiographics, Inc., Waukesha, Wis.

[21] Appl. No.: 571,114

[22] Filed: Jan. 16, 1984

[51] Int. Cl.[3] ..... B65D 77/24; G09F 3/00

[52] U.S. Cl. ..... 206/216; 206/459; 206/309; 40/312

[58] Field of Search ..... 206/216, 459, 309; 229/40; 40/312

[56] References Cited

U.S. PATENT DOCUMENTS

| | | | |
|---|---|---|---|
| 1,689,155 | 10/1928 | Rittenhouse | 40/312 |
| 3,463,303 | 8/1969 | Gorman et al. | 206/216 |
| 3,571,960 | 3/1971 | Karel | 40/312 |

*Primary Examiner*—William T. Dixson, Jr.
*Attorney, Agent, or Firm*—Bayard H. Michael

[57] ABSTRACT

A promotional device which preferably includes a laminated record which can be detached along a perforated line is attached to the bottle or can carrier by means of spaced arms projecting from the device and having lock tabs which engage spaced webs in the carrier. When attached to the carrier the promotional device is positioned closely adjacent the side of the carrier and resists accidental removal.

8 Claims, 8 Drawing Figures

PROMOTIONAL ATTACHMENT FOR BEVERAGE PACKAGES

BACKGROUND OF THE INVENTION

Beer and soda are sold in six-packs, eight-packs and the like, either made of cardboard formed to provide pockets for the containers (container retaining means) or made of plastic having undersized openings (container retaining means) capturing the upper edge of individual cans or bottles. When there is a special promotion, the point of sale promotional message is usually separate from the package since a short duration promotion does not justify the expense of changing the packaging. If it is desireable to attach the promotional item, it has been necessary to glue or tie the item to the package.

Inexpensive laminated records are well-known. Such a record can have a color picture or message covered with a clear plastic laminate which is embossed with an audio groove so it can be played on a regular record player. These records are very attractive promotional pieces since they provide sound in addition to the picture and/or message.

Being in the business of manufacturing the laminated records, applicant's assignee is interested in increasing the market for such records. This leads to a desire to provide means to attach such records to the beverage packages without glue or ties.

SUMMARY OF THE INVENTION

The principal object of this invention is to provide a promotional device (which may include a laminated record) which can be easily attached to a bottle or can carrier and can withstand reasonable handling after attachment without being disengaged from the package. The attachment is self-locking. The device is retained and oriented to assure maximum visibility and effect.

DETAILED DESCRIPTION OF THE DRAWINGS

Figure 1:
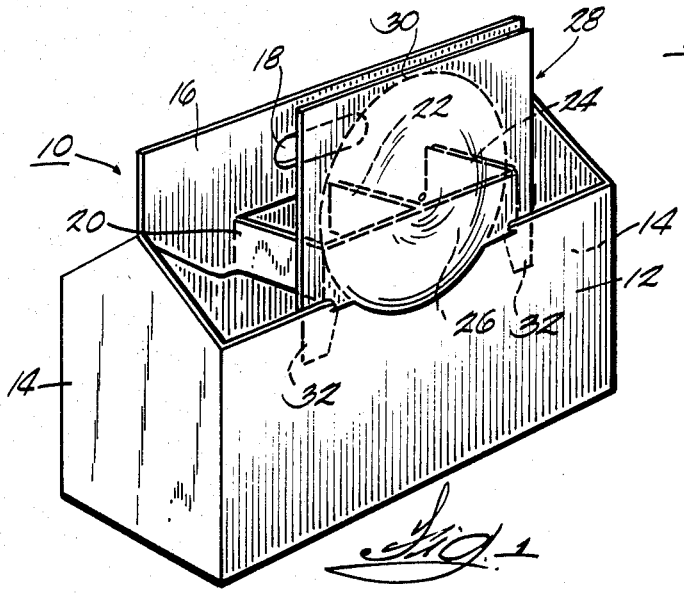
FIG. 1 is a perspective view of an eight-bottle carton with the promotional piece attached thereto.

The eight-bottle carton 10 shown in FIG. 1 is a typical construction having side panels 12 interconnected by end panels 14 and provided with a medial handle 16 apertured at 18 to provide a hand hold and having webs 20, 22, 24 interconnecting the handle and the upstanding portion 26 of the side panel 12.

The promotional piece 28 has a planar portion with circular perforations 30 permitting removal of the central portion 42 which is a laminated record containing an audio promotional message or music or the like. The record is plastic laminated to a cardboard substrate. The audio grooves are embossed into the plastic. Printing or other graphics can be applied to the cardboard prior to covering with the plastic. Thus, the promotional piece has both visual and audio capability.

Figure 3:
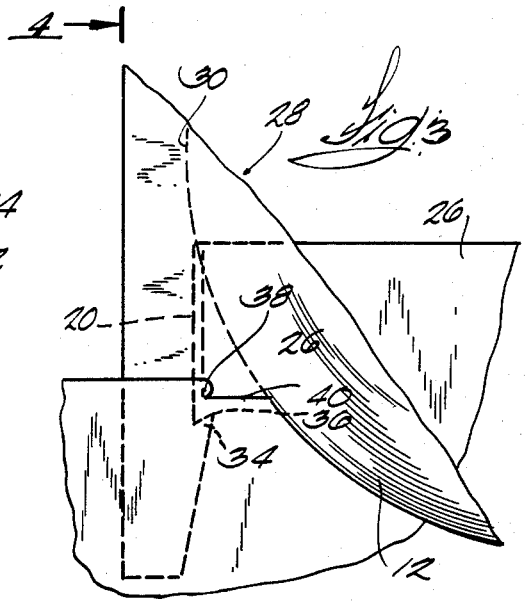
FIG. 3 is a partial front elevation showing the details of attachment of one arm to the web or divider in the carton.
Figure 5:
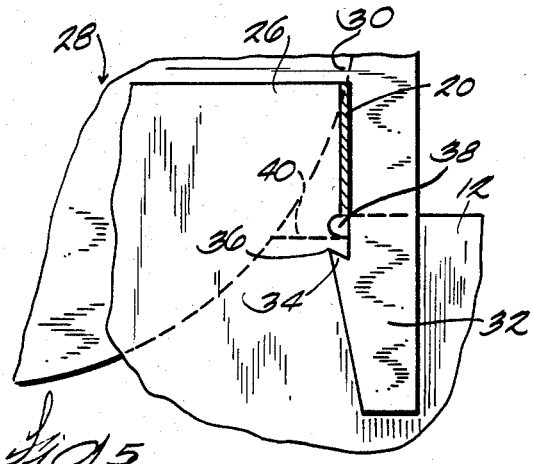
FIG. 5 is a rear view of the connection and is taken as viewed from line 5—5 in FIG. 4.
Figure 4:
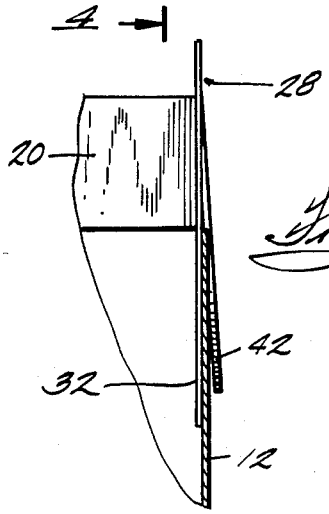
FIG. 4 is a partial section taken from the side in FIG. 3 as indicated by lines 4—4 in FIG. 3.
Figure 2:
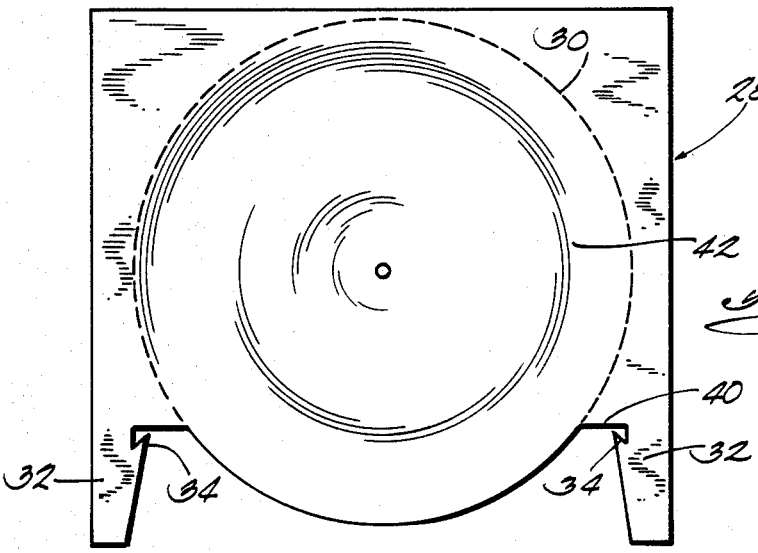
FIG. 2 is a plan view of the promotional piece.

As seen in FIG. 2, the planar promotional piece 28 has arms 32 depending from the main portion of the piece at each of the lower corners. Each arm includes a lock tab 34 on the inside of the arm. The arms are spaced so as to require some deflection of the lock tabs as they pass over the webs 20 and 24 in the carton. Thus, as can be seen in FIGS. 3 and 5, the corner 36 of the lock tab 34 lies inside of the inner surface of the web 20. As a standard construction feature the carton panel 12 has a circular die cut 38 at the junction of the main part of the panel 12 and the upstanding portion 26 which is also the point where the web 20 is folded back on a score line to join the medial handle. The short horizontal edge 40 adjacent the arm 32 rests on the bottom of this die cut point. The record 42 of the promotional piece is positioned on the outside of the side panel 12 while the legs extend behind the panel and engage the web to prevent accidental removal of the promotional piece. The piece may, however, be readily removed simply by pulling it free or, with a little extra care, one could remove just the record portion by punching along the perforated line 30. There isn't much purpose, however, in trying to remove the record without removing the piece from the carton.

It will be noted, therefore, that the bottle carrier has multiple webs interconnecting parts of the carrier and dividing the carrier into individual pockets receiving bottles. These pockets constitute container engaging or retaining means. The webs extend between the retaining means. The arms include lock tabs engageable with the webs to retain the promotional piece on the carton with the promotional piece positioned outside of the carton in full view.

Figure 6:
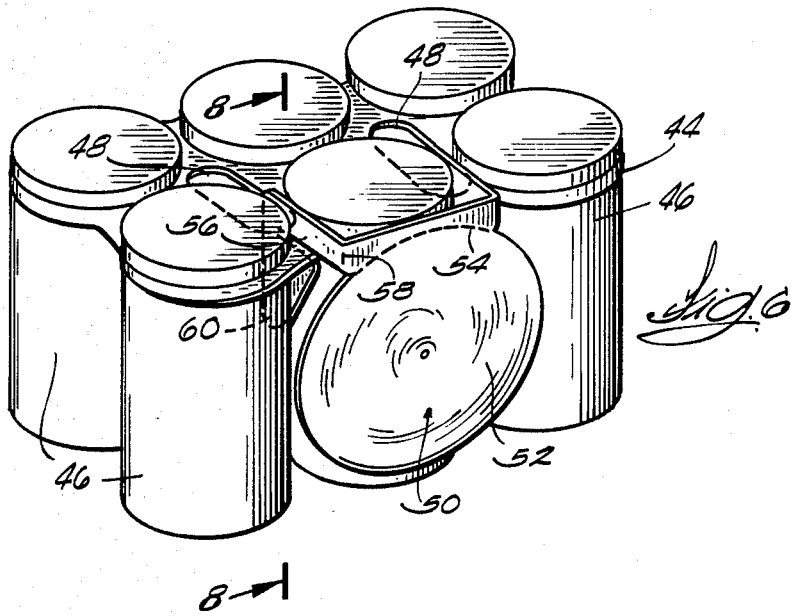
FIG. 6 is a perspective view showing another form of a promotional piece attached to the plastic web-type carrier for a six-pack of soda or beer.
Figure 8:
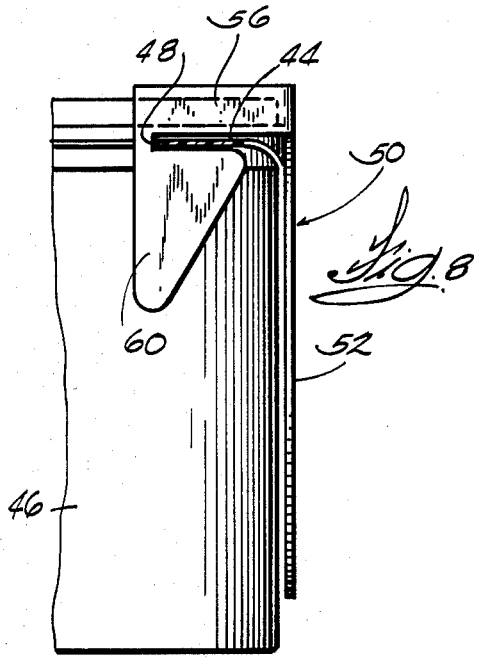
FIG. 8 is a section taken on line 8—8 in FIG. 6 to show the manner in which the locking tabs on the arms engage the plastic webbing of the carrier.
Figure 7:
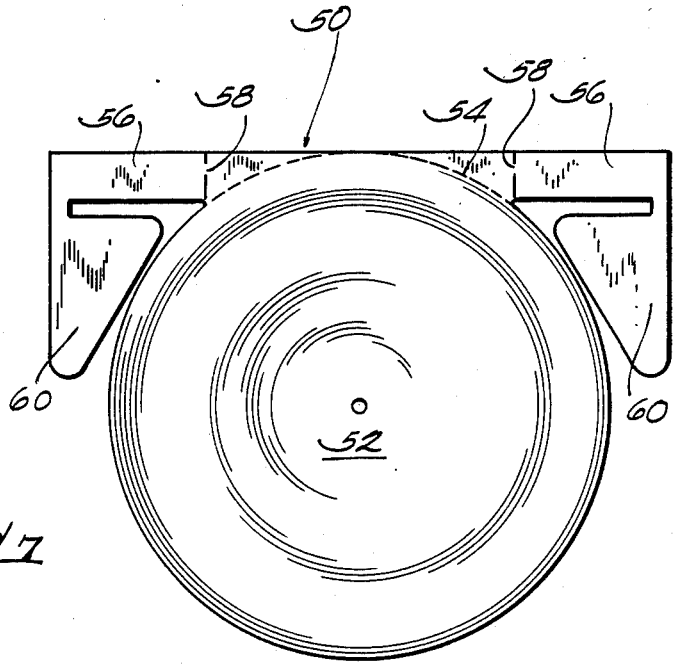
FIG. 7 is a plan view of the promotional piece prior to bending the attaching arms rearwardly on the score lines.

The plastic six-pack carrier 44 (FIG. 6) has slightly undersized apertures which snap over the upper rim of the cans 46. The apertures constitute container engaging or retaining means and the plastic membrane or webs extend between the container retaining means. Various designs of such plastic carriers 44 are used in the trade but all of them have one form or another of apertures 48 which permit insertion of the fingers and thumb to carry the package.

The promotional device 50 includes a laminated record portion 52 and the perforations 54 facilitating removal of the record. The promotional piece also has arms 56 connected to the main body by a portion including the scored fold lines 58 along which the arms are folded back so as to project over the aperture 48 to permit the lock tab 60 to engage the plastic web and retain the promotional piece closely adjacent the side of the six-pack to be protected when six-packs are stacked at the point of sale. To remove the promotional piece, the user can either tear the arms or separate the record 52 from the arm structure by punching along the perforated line 54.

I claim:

1. Combination with a beverage container carrier of the type having a multiplicity of individual container retaining means and spaced webs extending between said means and connecting portions of the carrier, of a promotional device attached to the package, the device including a planar message bearing surface and an arm extending therefrom, said arm having a tab which engages one of the webs to resist removal of the arm from engagement with the web.

2. The combination of claim 1 in which the device includes two such arms each of which engages a separate web so the device is supported at spaced apart points.

3. The combination of claim 2 in which the arms are shaped relative to the message bearing surface and the webs engaged by the arms to position the message bearing surface generally in the same plane as the plane of the side of said package.

4. The combination according to claim 3 in which the medial portion of the side surface is higher than the ends of said side surface, said arms projecting inwardly of the side panel on either side of the higher medial portion.

5. The combination of claim 2 in which the message bearing surface is parallel to and outside of the side of the package.

6. The combination of claim 5 in which the support arms extend inwardly and transversely of the carrier from the message bearing surface said support arms being generally parallel to the base of the carrier.

7. The combination with a beverage container carrier of the type having a bottom, sides and ends and a medial divider including a handle and webs extending between the divider and the sides to form individual container pockets, of a promotional device having a surface bearing promotional material, and an arm projecting from each side of the surface and spaced to lie adjacent spaced webs, each arm including a tab to engage the adjacent web to resist removal of the promotional device while retaining the device parallel to and outside of the sides of the carrier.

8. The combination with a beverage container carrier of the type having a multiplicity of container retaining means and spaced webs between said means and connecting portions of the carrier, of a promotional device including a planar surface on which a message may be placed, said planar surface being perforated to permit removal of a portion of said planar surface to serve as a useful article, spaced arms extending from said planar surface outside said portion, a lock tab on the end of each arm for retaining the arm on one of said webs.

* * * * *